US005361524A

United States Patent [19]

Karkau et al.

[11] Patent Number: 5,361,524

[45] Date of Patent: Nov. 8, 1994

[54] GAS POWERED WEAPON SYSTEM INCLUDING AN IMPROVED GAS SEAL

[76] Inventors: Robert R. Karkau, 25030 Loma Prieta Ave., Los Gatos, Calif. 95030; Marc S. Wortz, 307 Western Dr., Santa Cruz, Calif. 95060; Michael D. Conner, 137 Marina Ave., Aptos, Calif. 95003

[21] Appl. No.: 92,318

[22] Filed: Jul. 14, 1993

[51] Int. Cl.[5] ..... F41C 9/02

[52] U.S. Cl. ..... 42/1.16; 124/41.1; 124/74

[58] Field of Search ..... 42/1.16, 1.08, 1.12; 124/41.1, 42, 74, 57; 89/1.34, 7

[56] References Cited

U.S. PATENT DOCUMENTS

| | | | |
|---|---|---|---|
| 1,897,992 | 2/1933 | Ailes | 42/1.16 |
| 2,375,314 | 5/1945 | Mills | 124/57 |
| 2,725,048 | 11/1955 | Koogle | 124/74 |
| 3,630,151 | 12/1971 | Rakowsky | 89/7 |
| 3,815,502 | 6/1974 | Mawhinney | 102/42 C |
| 3,830,214 | 8/1974 | Curtis | 124/41.1 |
| 3,889,652 | 6/1975 | Curtis | 124/41.1 |
| 5,230,324 | 7/1993 | Van Horssen et al. | 124/74 |

*Primary Examiner*—Stephen M. Johnson
*Attorney, Agent, or Firm*—Robert O. Guillot

[57] ABSTRACT

A gas powered weapon including a housing for holding a pressurized gas cartridge and a projectile. A hammer mechanism is utilized to drive the cartridge into a stationary firing pin to cause the discharge of the cartridge thus providing a pulse of pressurized gas to shoot a projectile outwardly. A gas seal is disposed adjacent the firing pin to prevent back pressure behind the cartridge, whereby maximum gas pressure is available to shoot the projectile. The gas seal is located away from the non-firing position of the cartridge, such that the gas seal does not impede the motion of the cartridge when the device is fired.

5 Claims, 1 Drawing Sheet

2
110
100,101
10
110
12
30
22
32
56
34
24
2
26
28
76
81
81
74
84
120
85
78
18
83
82
72
14
80
70
74
138
100,101
30
110
112
16
60
32
34
56
24
26
44
50
110
52
40
12
42
28
84
86
88
90
92
88
104
102
104
100
101
122
132
128
134
126
130
124
120
126
120
130
128
122

120
122
132
134
136
124
120
126
122
130
128
122
132
134
120
136

GAS POWERED WEAPON SYSTEM INCLUDING AN IMPROVED GAS SEAL

BACKGROUND OF THE INVENTION

1. Field of the Invention

This disclosure pertains generally to weapon systems, and more particularly to a gas seal for a high impact, non-lethal gas powered system.

2. Brief Description of the Prior Art A prior art gas powered weapon system is described in U.S. Pat. Nos. 3,830,214 and 3,889,652. As taught therein, the weapon system is comprised of a projectile launcher and gas powered cartridge assembly that is insertable therein. The launcher is comprised of a selectively releasable spring loaded piston that is slidably located in a handle member. The handle member is engaged to a connecting end of a barrel member, and the connecting end of the barrel defines a receiver wherein a cartridge assembly is inserted.

The cartridge assembly is comprised of a cylindrical case having a deformable projectile and one or more pressurized gas cartridges slidably disposed in opposite ends thereof. A sharp edged piercing element is immovably supported within the case and directed towards an exterior surface of the gas cartridge The piercing element is adapted to puncture the gas cartridge in response to displacement of the gas cartridge by selective release of the piston, whereby the releasable pressure energy of the gas within the gas cartridge is utilized as a launching means for the projectile.

In another aspect of the prior art device, it is taught that when the pressurized gas cartridge is punctured to release the pressurized gas, that a substantial amount of pressurized gas energy release can be lost due to leakage between the inner surface of the cylindrical case supporting the gas cartridge and the outer surface of the gas cartridge itself. Various gas seal means are described to effectively seal an end portion of the pressurized gas cartridge against the passage of the gas by utilizing a sealing force generated by the pressure of the gas media. The various prior art gas seal members are depicted in FIGS. 9, 10, 11 and 12 of U.S. Pat. No. 3,889,652 and described therein. These gas seal members have the general deficiency that they are designed to move or flex with movement of the gas cartridge within the device. In this functional capacity, the seals may tend to impede the required movement of the gas cartridge during the puncturing thereof, resulting in the possible malfunction of the device. Such a malfunction can have potentially disastrous and life-threatening consequences where the device is utilized to impede an attacker and it misfires.

SUMMARY OF THE INVENTION

The gas powered weapon system of the present invention includes an improved gas seal. The improved gas seal is designed to be fixedly engaged within a forward portion of the gas cartridge firing chamber of the device, such that it will not impede the sliding movement of the gas cartridge that occurs during the firing of the device. It includes a central bore that acts as a guide for the narrowed neck portion of a gas cartridge. Additionally, the improved gas seal includes a beveled sealing surface that sealingly engages the sloped outer surface of the cylindrical gas cartridge, whereby an effective seal is produced upon the discharge of the cartridge. In the preferred embodiment, the improved gas seal is composed of a hard material, such as a metal or a firm plastomeric material.

It is an advantage of the present invention that an improved gas powered weapon system is provided.

It is another advantage of the present invention that it includes an improved gas seal which is fixedly installed within the device to facilitate the reloading a gas cartridge.

It is a further advantage of the present invention that it includes an improved gas seal which substantially decreases the likelihood that the device will misfire as a result of jamming caused by improper alignment or movement of the gas seal within the device.

These and other features and advantages of the present invention will become more apparent from the following detailed description of the preferred embodiment taken in conjunction with the accompanying drawings.

IN THE DRAWING

DETAILED DESCRIPTION OF THE PREFERRED EMBODIMENT

Figures 1, 2, 3, 4, 5, 6, 7, 8, 9:
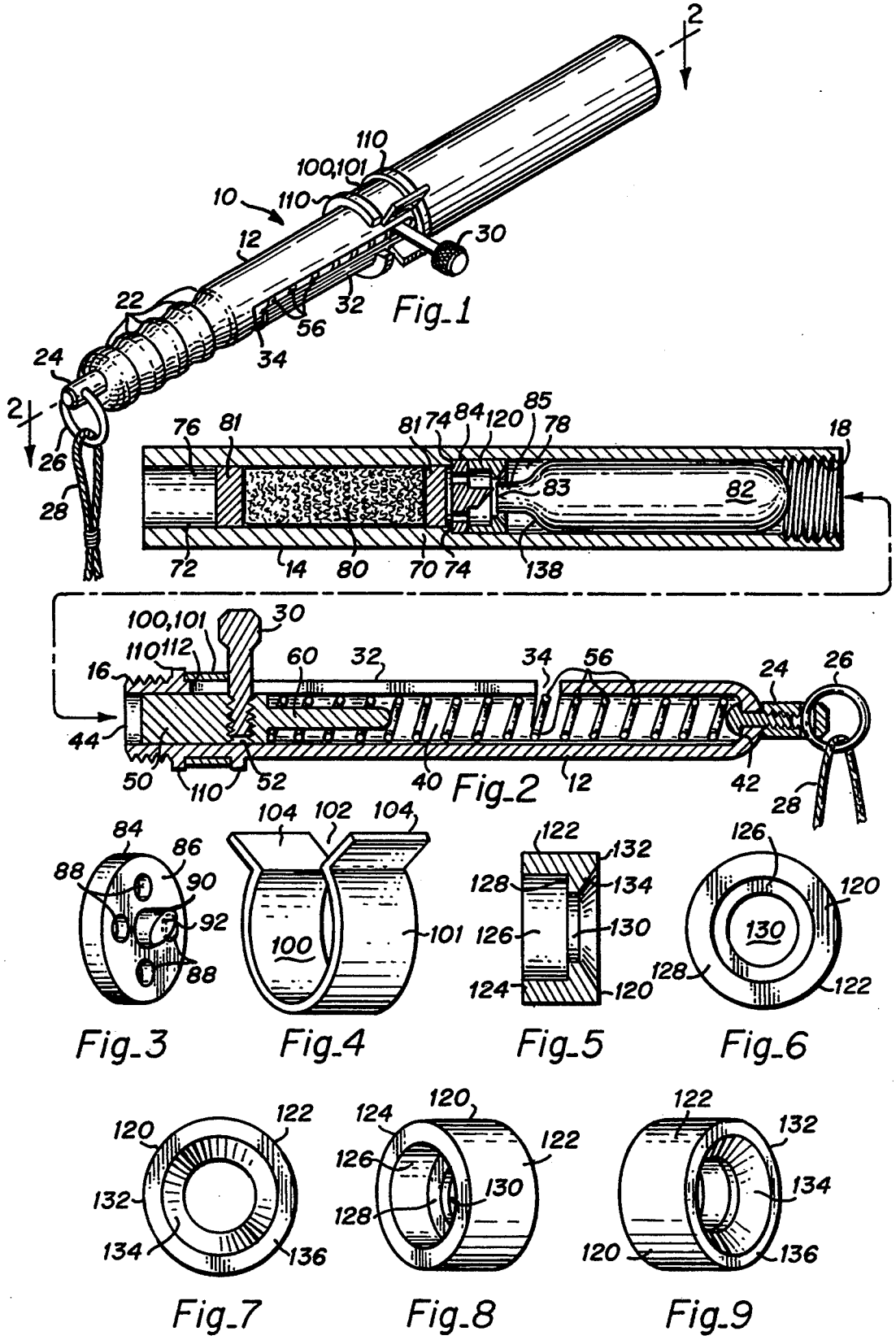
FIG. 1 is a perspective view of the gas powered weapon system of the present invention.
FIG. 2 is a side cross-sectional view of the present invention, taken along lines 2—2 of FIG. 1.
FIG. 3 is a perspective view of the gas cartridge firing pin member depicted in FIG. 2.
FIG. 4 is a perspective view of the firing safety ring depicted in FIGS. 1 and 2.
FIG. 5 is an enlarged cross-sectional view of the improved gas seal of the present invention.
FIG. 6 is an end elevational view of the gas seal depicted in FIG. 3, taken along lines 6—6 of FIG. 3.
FIG. 7 is an end elevational view of the gas seal depicted in FIG. 3, taken along lines 7—7 of FIG. 3.
FIG. 8 is a perspective view of the gas seal taken from the end thereof depicted in FIG. 6.
FIG. 9 is a perspective view of the gas seal taken from the end thereof depicted in FIG. 7.

As depicted in FIGS. 1 and 2 of the drawings, the present invention 10 is a generally cylindrical baton-like device that includes a handle portion 12 and a gas cartridge holding portion 14 that are threadably engageable together utilizing the threaded end portions 16 and 18 respectively thereof. The handle portion 12 includes a series of projecting hand-hold ridges 22 to facilitate the handling of the device and a strap keeper 24 having a strap ring 26 engaged thereto, with a carrying strap 28 disposed within the strap ring 26.

A firing bolt 30 projects radially outwardly through a bolt slot 32 formed longitudinally through a portion of the side of the cylindrical handle 12. The rearward end of the bolt slot 32 is formed with a bolt holding portion 34 that is cut circumferentially through the side of the handle 12. It is therefore to be understood that the firing bolt 30 may be pulled rearwardly within the slot 32 to the rearward end of slot 32 and then pushed downwardly to reside within the bolt holding portion 34 of the slot 32. When the firing bolt 30 is pulled rearwardly and into the bolt holding portion 34, it is in the cocked (ready to fire) position.

As is best seen in FIG. 2, the handle 12 is formed with a cylindrical bore 40 that is closed at the rearward end 42 and open at the forward end 44. A solid cylindrical firing hammer 50 is slidably engaged within the bore 40.

The bolt 30 is threadably engaged in a threaded bore 52 formed in the firing hammer 50, such that the rearward movement of the bolt 30 causes the rearward sliding movement of the hammer 50 within the bore 40. A coil spring 56 is disposed within the cylindrical bore 40 between the hammer 50 and the rearward end 42 of the bore 40. To facilitate the engagement of the spring 56 with the hammer 50, the hammer is formed with a cylindrical, rearwardly projecting spring engagement portion 60.

It is therefore to be understood that when the firing bolt 30 is in the cocked position, as described above, that the coil spring 56 is compressed behind the rearwardly disposed firing hammer 50. Thereafter, when the firing bolt 30 is dislodged from its cocked position by movement thereof out of the bolt holding portion 34 of the slot 32, that the coil spring will forcibly urge the firing hammer 50 forwardly towards the frontward end 44 of the handle bore 40.

As is best depicted in FIG. 2, the gas cartridge holding portion 14 of the weapon 10 comprises a cylindrical tubular housing 70 having a cylindrical bore 72 formed therethrough. The cylindrical bore 72 is formed with an annular shoulder 74, whereby the bore 72 comprises an outer bore section 76 having a smaller diameter than the inner bore section 78. A stun bag or other projectile 80 is disposed within the outer bore section 76 and held therewithin by ejectable plug members 81.

The rearward end of the inner bore section 78 includes the internally threaded portion 18 for threadable mating with the exterior threads 16 of the handle 12. A gas cartridge 82 is removably disposed within the bore 78, such that its gas release end 83 is disposed forwardly at the front end of a neck portion 85 of the cartridge 82. A firing pin member 84 is disposed within the forward end of the inner bore 78. As is best understood with the aid of FIG. 3, the firing pin 84 includes a disc shaped portion 86 having a diameter which is sufficient to permit the firing pin 84 to rest against the annular shoulder 74. A plurality of gas passage holes 88 are formed through the disc portion 86 to permit the passage of projectile firing gas therethrough. A cylindrical gas cartridge piercing pin 90 projects rearwardly from the center of the disc 84. The cartridge piercing pin 90 includes a sharpened end portion 92 to facilitate the puncturing of the gas release end 83 of the gas cartridge 82. In the preferred embodiment, the cartridge piercing pin 90 is formed with a diameter of approximately 0.093 inches, a length of approximately 0.3 inches (to the sharpened tip), and an end face which is cut at a 45 degree angle relative to the central axis of the pin 90. The diameter of the disc shaped portion 86 is approximately 0.75 inches, whereas the diameter of the inner bore 78 in which the firing pin 84 resides is approximately 0.748 inches, whereby the firing pin member 84 is tightly press fit into the forward end of the inner bore 78, against the annular shoulder 74.

It is therefore to be understood that upon the forward motion of the gas cartridge 82, its gas release end 83 will be urged into piercing contact with the cartridge piercing pin 90 of the firing pin 84. Thereafter, upon the puncturing of the gas release end 83, the expanding released gas from the cartridge will pass through the holes 88 in the firing pin 84 and propel the projectile 80 out of the forward end of the bore 72. It is to be further understood that when the cartridge holding portion 14 and the handle portion 12 of the weapon 10 are threadably engaged utilizing the mating threads 16 and 18, that the firing hammer 50 will make physical contact with the rearward end of the gas cartridge 82 disposed within the bore 78, such that the forward motion of the hammer 50, caused by the coil spring 56, will be sufficient to slidably propel the gas cartridge 82 into the firing pin 84 to cause the puncturing of the gas release end 83, and the gas discharge of the gas cartridge 82.

A firing safety ring 100 is slidably engaged to the forward end of the handle 12. As is best seen with the aid of FIG. 4, the safety ring 100 is formed as a circular band 101 having an arcuate gap 102 formed therein, with radially projecting finger manipulation tabs 104 formed from each end of the band 101. The safety band 100 is formed with a diameter which permits it to slidably reside about the outer surface of the handle 12 between two radially projecting annular ridges 110. As is best seen in FIGS. 1 and 2, the forward end 112 of the bolt slot 32 projects into the frontward portion of the handle 12 between the two annular rings 110, such that FIG. 1 depicts the device in the fired position, whereas the position of the firing bolt 30 depicted in FIG. 2 is in the safety position. More specifically, when the safety band 100 is rotated between the annular projections 110, such that a portion of the body 101 of the safety band 100 covers the forward end 112 of the slot 32 (see FIG. 2), the firing hammer 50 cannot make contact with the gas cartridge 32 because the firing bolt 30 is prevented from traveling to the forward end 112 of the slot 32 by the portion of the safety band 101 which covers the slot 32. Conversely, when the safety band 100 is rotatably positioned such that the gap 102 is positioned over the forward end 112 of the bolt slot 32 (as depicted in FIG. 1), the firing bolt can progress forwardly to the fullest extent of the forward end 112 of the bolt slot 32, and the firing hammer 50 can make full impact with the gas cartridge 82, propelling it into the firing pin 84 and causing the discharge of the weapon.

A gas seal member 120 is fixedly engaged within the forward portion of the bore 78 between the firing pin 84 and the gas cartridge 82. As is best seen in FIG. 2, with the aid of FIGS. 5, 6, 7, 8 and 9, the gas seal 120 has a generally cylindrical outer surface 122 having a diameter which is slightly greater than the inner diameter of bore 78, such that the seal 120 may be press fit within the bore 78. The forward portion 124 of the seal 120 includes an internal cylindrical cavity portion 126 which has a rearward termination in an annular shoulder 128, and a centrally disposed bore 130 is formed through the shoulder 128. The diameter of the bore 130 is large enough to permit the unimpeded longitudinal movement of the neck portion 85 of the gas cartridge 82 therethrough, such that the forward end 83 of the gas cartridge can make piercing contact with the firing pin 84. The rearward portion 132 of the gas seal 120 is formed with a truncated cone-shaped cavity 134 which projects outwardly and rearwardly from a narrow diameter that constitutes the bore 130 towards an outer diameter which terminates at the rearward surface 136 of the seal 120. The slope of the cone-shaped cavity 134 is selected to facilitate a contacting seal with the rounded, sloped forward surface 138 of a typical gas cartridge 82. In the preferred embodiment, the slope of the walls of the cone-shaped cavity 134 is approximately between 40 degrees and 50 degrees, with the preferred embodiment having a slope approximately 45 degrees. The outer diameter of the gas seal member 120 is approximately 0.75 inches, whereas the inner diameter of the housing bore 78 is approximately 0.748 inches, whereby the gas seal 120 is press fit into the housing bore 78 immediately against the firing pin 84. The overall length of the gas seal member 120 is preferably approximately 0.312 inches, wherein the cylindrical cavity portion 126 is formed with a length of approximately 0.2 inches and a diameter of approximately 0.65 inches. The central bore 130 is formed with a diameter of approximately 0.37 inches and the rearward, outer diameter of the cone-shaped cavity 134 is approximately 0.55 inches.

As will be understood with the aid of FIG. 2, when the gas cartridge 82 is propelled by the hammer 50 into the firing pin 84 to cause the discharge of compressed gas within the cartridge 82, the sides of the bore 130 will act to guide and assure the alignment of the neck 85 of the cartridge 82 with the piercing pin 90, and that the sloped sides of its cone-shaped cavity 134 make a substantially sealing contact with the sloped forward surface 138 of the gas cartridge 82. Thereafter, because the gas cartridge is urged in its forwardmost position by the firing hammer 50, with its forwardly urging coil spring 56 therebehind, the discharging gas from the gas cylinder 82 will pass primarily through the gas holes 88 in the firing pin 84 to urge the projectile 80 outwardly through the forward end of the bore 72. Thus, while there is a small portion of the gas pressure that may find some release in escaping through any gap between the cone-shaped surface 134 and the forward surface 138 of the gas cartridge 82, the great percentage of the escaping gas from the gas cartridge 82 will project forwardly through bore 72, to propel the projectile 80 forwardly out of the weapon. It is therefore to be understood that the overall length of the gas seal 120 is chosen such that the forward end 83 of the cartridge 82 will make full piercing contact with the piercing pin 90 before the sloped sides of the cartridge make a gas sealing contact with the cone-shaped surface of the cavity 134 of the gas seal 120. Stated differently, the overall length of the gas seal 120 is determined by the length of the neck portion 85 of the gas cartridge 82 that will be loaded into the device. In a like manner, the diameter of the bore 130 is determined by the diameter of the neck portion of the cartridge 82, such that the neck will easily slide within the bore 130 yet be guided to the piercing pin 90. The diameter of the bore 130 is thus both somewhat larger than the diameter of the neck portion 85, and significantly less than the diameter of the body of the cartridge 82. The length of the bore 130 must be less than the length of the neck portion 85 in order to allow puncturing of the cartridge by the pin 90.

The significant improvements that are realized with the utilization of the gas seal 120 of the present invention are that a more reliable firing of the device is achieved, and that there is a reduction in the possibility that the cartridge might become jammed within the bore 78, whereby the forward movement of the cartridge would be impeded or prevented. The gas seals shown in the prior art each created the possibility that the forward motion of the cartridge could be inhibited or prevented, and/or that a less than adequate gas seal would exist upon firing the device. As described hereinabove, in the present invention the gas seal 120 is fixedly engaged in a forward position, and does not make contact with the cartridge until the cartridge is pushed forwardly into the firing position by the hammer 50. The dimensions of the seal 120 are such that the cartridge puncturing pin 90 penetrates the forward end 83 of the cartridge prior to the sloped sides of the cartridge making contact with the bevelled surface of the cone-shaped cavity 34. Because the weapon would only be fired at an intruder or adversary in a potentially life threatening situation, the possibility that the weapon might misfire due to a gas seal induced jamming of the cartridge is entirely and absolutely unacceptable. The improved gas seal described hereinabove provides a level of safety and security for its owner that distinguishes it from the previously known devices of its kind.

While the present invention has been shown and described with reference to certain preferred embodiments, it will be understood by those skilled in the art that certain modifications and variations may be made therewith without departing from the true spirit, scope and fair meaning of the invention.

What is claimed is:

1. A gas powered weapon system comprising:

a housing for holding a pressurized gas cartridge and a projectile therewithin; said gas cartridge being generally cylindrical and including a body portion and a neck portion, said neck portion having a length and having a smaller diameter than the diameter of said body portion;

a gas cartridge firing means, said firing means having a cartridge piercing member and being disposed within said housing and functioning to cause the gaseous discharge of said gas cartridge; said gas cartridge being movable within said housing from a non-firing position wherein said cartridge is not pierced by said cartridge piercing member, to a firing position wherein said cartridge is pierced by said cartridge piercing member;

a gas seal, said gas seal being fixedly disposed within said housing adjacent to said cartridge piercing member and functioning to cause pressurized gas released by said cartridge to propel said projectile outwardly from said housing; and said gas seal having a bore formed therethrough, said bore having a diameter that is both larger than the diameter of said neck portion of said cartridge and substantially smaller than the diameter of said body portion of said cartridge;

said gas seal being disposed away from said gas cartridge when said gas cartridge is in said non-firing position.

2. A device as described in claim 1 wherein said housing comprises a generally tubular member having a cylindrical bore formed therewithin;

said gas seal including a seal body portion having a generally cylindrical outer shape having a central axis therethrough, and being defined by a cylindrical diameter and a cylinder length;

said bore of said gas seal being centrally disposed within said seal body and coaxially disposed relative to said central axis.

3. A device as described in claim 2 wherein said gas cartridge is formed with a sloped outer surface between said neck portion and said body portion thereof;

said gas seal including a cone-shaped cavity formed within said body portion between said bore and a rearward surface of said gas seal, said cone-shaped cavity having a central axis that is coaxial with said central axis of said seal body portion;

said cone-shaped cavity being formed to sealingly engage said sloped surface portion of said gas cartridge when said cartridge is disposed in said firing position.

4. A device as described in claim 2 wherein said bore of said gas seal is formed with a length that is less than said length of said neck portion of said cartridge.

5. A device as described in claim 1 wherein said housing includes a handle portion; and wherein said gas cartridge firing means further includes a cartridge driving means, said driving means including a cartridge hammer portion being slidably disposed within said handle portion and a spring means also being disposed within said handle portion, said hammer portion being activatable by a user of said device to be slidably driven by said spring means to forcibly strike a rearward portion of said cartridge, to drive said cartridge into said cartridge piercing member.

* * * * *